US006147549A

United States Patent [19]

Ohno

[11] Patent Number: 6,147,549

[45] Date of Patent: Nov. 14, 2000

[54] REFERENCE VOLTAGE GENERATING CIRCUIT OF GENERATING A PLURALITY OF REFERENCE VOLTAGES

[75] Inventor: Kazuki Ohno, Tokyo, Japan

[73] Assignee: NEC Corporation, Tokyo, Japan

[21] Appl. No.: 09/106,266

[22] Filed: Jun. 29, 1998

[30] Foreign Application Priority Data

Jun. 27, 1997 [JP] Japan ..... 9-172055

[51] Int. Cl.[7] ..... G05F 1/10

[52] U.S. Cl. ..... 327/541; 327/543; 323/313

[58] Field of Search ..... 327/530, 538, 327/540, 541, 543; 323/313

[56] References Cited

U.S. PATENT DOCUMENTS

| | | | |
|---|---|---|---|
| 4,267,505 | 5/1981 | Biglin | 324/65 R |
| 5,105,102 | 4/1992 | Shioda | 326/73 |
| 5,381,034 | 1/1995 | Thrower et al. | 257/529 |
| 5,559,424 | 9/1996 | Wrathall et al. | 323/277 |
| 5,818,212 | 10/1998 | Min et al. | 323/314 |
| 5,933,051 | 8/1999 | Tsuchida et al. | 327/543 |

FOREIGN PATENT DOCUMENTS

| | | |
|---|---|---|
| 62-274909 | 11/1962 | Japan . |
| 56-65190 | 6/1981 | Japan . |
| 56-132815 | 10/1981 | Japan . |
| 63-55530 | 3/1988 | Japan . |
| 64-39512 | 3/1989 | Japan . |
| 4-157909 | 5/1992 | Japan . |
| 5-100756 | 4/1993 | Japan . |
| 7-219658 | 8/1995 | Japan . |

*Primary Examiner*—Timothy P. Callahan
*Assistant Examiner*—Hai L. Nguyen
*Attorney, Agent, or Firm*—Foley & Lardner

[57] ABSTRACT

A reference voltage generating circuit comprises a differential amplifier having a first input connected to receive a constant voltage and a second input connected through a voltage feedback path to an output of the differential amplifier so as to receive a voltage in proportion to an a first reference voltage outputted from the differential amplifier. A voltage divider composed of series-connected resistors is connected to the output of the differential amplifier so as to form a current path independent of the voltage feedback path, so that the voltage divider generates a second reference voltage different from the first reference voltage. Thus, a single reference voltage generating circuit generates a plurality of reference voltages.

2 Claims, 4 Drawing Sheets

REFERENCE VOLTAGE GENERATING CIRCUIT OF GENERATING A PLURALITY OF REFERENCE VOLTAGES

BACKGROUND OF THE INVENTION

1. Field of the Invention

The present invention relates to a reference voltage generating circuit, and more specifically to a reference voltage generating circuit of efficiently generating a plurality for reference voltages.

2. Description of Related Art

A reference voltage generator stably generates a voltage to be used as a reference, and supplies the reference voltage to a circuit which is internally provided in a semiconductor device and which needs the reference voltage. The reference voltage generator is required to generate a voltage which is always constant even if a variation occurs in an operating condition such as a voltage supply voltage and temperature. Ordinarily, in other words, the reference voltage generator cannot generate a varying voltage.

Since a reference voltage generator can generate only the constant voltage, it is the prior art practice that a differential amplifier and resistors are used in order to generate a desired voltage from the generated constant voltage, disclosed in for example Japanese Patent Application Pre-examination Publication No. JP-A-62-274909, (an English abstract of JP-A-62-274909 is available from the Japanese Patent Office and the content of the English abstract of JP-A-62-274909 is incorporated by reference in its entirety into this application).

Referring to FIG. 1, there is shown a circuit diagram disclosed in JP-A-62-274909. In the shown prior art reference voltage generating circuit, a reference voltage generator 1 generates a reference voltage $V_{ref}$ which is at a constant even if a variation occurs in an operating condition including a voltage supply voltage and a temperature. The reference voltage $V_{ref}$ is supplied to a non-inverted input of a differential amplifier 2, which has an output fed back to an inverted input of the differential amplifier 2 through a selected one or ones of series-connected resistors $R_1$ to $R_{64}$ in a selection circuit 3. The selection circuit 3 includes a number of selection transistors $Q_{101}$ to $Q_{364}$ connected as shown between the inverted input of the differential amplifier 2 and 64 connections nodes $N_1$ to $N_{64}$ of the series-connected resistors $R_1$ to $R_{64}$, in order to connect a selected one of the connections nodes $N_1$ to $N_{64}$ of the series-connected resistors $R_1$ to $R_{64}$, to the inverted input of the differential amplifier 2. For this purpose, the selection circuit 3 also includes a decoder circuit DEC and inverters $IV_3$ and $IV_4$, which receives control signals T1 to T6 to selectively turn on the selection transistors $Q_{101}$ to $Q_{364}$. Thus, it is possible to arbitrarily select an voltage dividing ratio of the output voltage $V_{ref2}$ of the differential amplifier 2, by the control signals T1 to T6, and therefore, to arbitrarily set the output voltage $V_{ref2}$.

Referring to FIG. 2, there is shown a simplified circuit diagram of a portion of the prior art reference voltage generating circuit excluding the reference voltage generator 1. In a simplified circuit 60 shown in FIG. 2, $V_O$ corresponds to $V_{ref}$ in FIG. 1, and $V_{ref}$ corresponds to $V_{ref2}$ in FIG. 1. A differential amplifier 10 corresponds to the differential amplifier 2 in FIG. 1. Series-connected resistors $R_1$ and $R_2$ connected between an output 50 of the differential amplifier 10 and the ground represent the series-connected resistors $R_1$ to $R_{64}$ in FIG. 1. A connection node between the series-connected resistors $R_1$ and $R_2$ is connected to an inverted input of the differential amplifier 10.

Now, an operation will be described with reference to the simplified circuit diagram shown in FIG. 2. The reference voltage $V_O$ is supplied to a non-inverted input 20 of the differential amplifier 10, and the inverted input of the differential amplifier 10 is connected to receive a voltage $V_1$ obtained by dividing the output voltage $V_{REF}$ of the differential amplifier 10 by a voltage divider formed of the resistors $R_1$ and $R_2$. At this time, the following relation holds:

$$V_1=V_{REF}\cdot R_2/(R_1+R_2) \quad (1)$$

Since the differential amplifier 10 operates to make the two inputs equal to each other, the following relation ultimately holds:

$$V_O=V_1 \quad (2)$$

Therefore, the desired reference voltage $V_{REF}$ is expressed as follows:

$$V_{REF}=V_O\cdot(R_1+R_2)/R_2 \quad (3)$$

Accordingly, a desired voltage can be obtained by adjusting the values of the resistors $R_1$ and $R_2$.

Here, a capacitor 40 having a capacitance C is connected between the output 50 of the differential amplifier 10 and the ground, as a compensating capacitance for stabilizing the output voltage $V_{REF}$.

In the prior art, when a plurality of different reference voltages are required, it was necessary to provide in a semiconductor device a plurality of circuits 61 to 63 each corresponding to the circuit 60 shown in FIG. 2, as shown in FIG. 3, and to make the resistance ratio between $R_1$ and $R_2$ in the circuits 61 to 63 different from one another, so that the circuits 61 to 63 generate different voltages. Therefore, when a plurality of different reference voltages are required, it is necessary to provide reference voltage generating circuits of the number equal to the number of the required reference voltages. This means that it is necessary to provide a plurality of circuits which are the same excluding the resistors, with the result that the chip size closely influencing the cost becomes large.

The size of the differential amplifier is not so large, but the resistor requires a large area, because it is necessary to make the resistance value large in order to minimize the electric power consumption. For example, when the resistance of $R_1+R_2$ is 1000 KΩ, the current flowing through these resistors $R_1$ and $R_2$ becomes 1 μA. For a low consumed current, it is the ordinary practice that the resistance value of $R_1+R_2$ is set in the range of 100 KΩ to 10 MΩ. For example, if the resistor of 1000 KΩ is formed of silicide, assuming that a sheet resistance of the silicide is about 10Ω/□, the length of 200 mm is required with the width of 2 μm. It would be understood that the resistor requires a large area.

Here, it may be supposed that it is sufficient if the resistor $R_1$ shown in FIG. 2 is divided into a plurality of resistors $R_{11}$ and $R_{12}$ as shown in FIG. 4, so that a plurality of reference voltages $V_{REF1}$ and $V_{REF2}$ are generated. However, because of a compensating capacitance $C_2$ added to stabilize $V_{REF2}$, the voltage $V_1$ fed back to the differential amplifier is delayed by the time constant of $R_{11}\cdot C_{12}$, so that a delay occurs in the control for the differential amplifier, and oscillation occurs in an extreme case. In this case, the reference voltage can be no longer utilized. Therefore, reference voltage generating circuits of the number equal to the number of required different reference voltages were required in the prior art.

SUMMARY OF THE INVENTION

Accordingly, it is an object of the present invention to provide a reference voltage generating circuit which has overcome the above mentioned defect of the conventional one.

Another object of the present invention is to provide a reference voltage generating circuit capable of stably generating a plurality of different reference voltages with a simple circuit construction.

The above and other objects of the present invention are achieved in accordance with the present invention by a reference voltage generating circuit comprising a first reference voltage generating means including a differential amplifier having a first input connected to receive a constant voltage and a second input connected through a voltage feedback means to an output of the differential amplifier so as to receive a voltage in proportion to a first reference voltage generated by the differential amplifier, and a second reference voltage generating means connected to the output of the differential amplifier and having a current path independent of the voltage feedback means, for generating at least a second reference voltage different from the first reference voltage.

The above and other objects, features and advantages of the present invention will be apparent from the following description of preferred embodiments of the invention with reference to the accompanying drawings.

DESCRIPTION OF THE PREFERRED EMBODIMENTS

Figure 5:
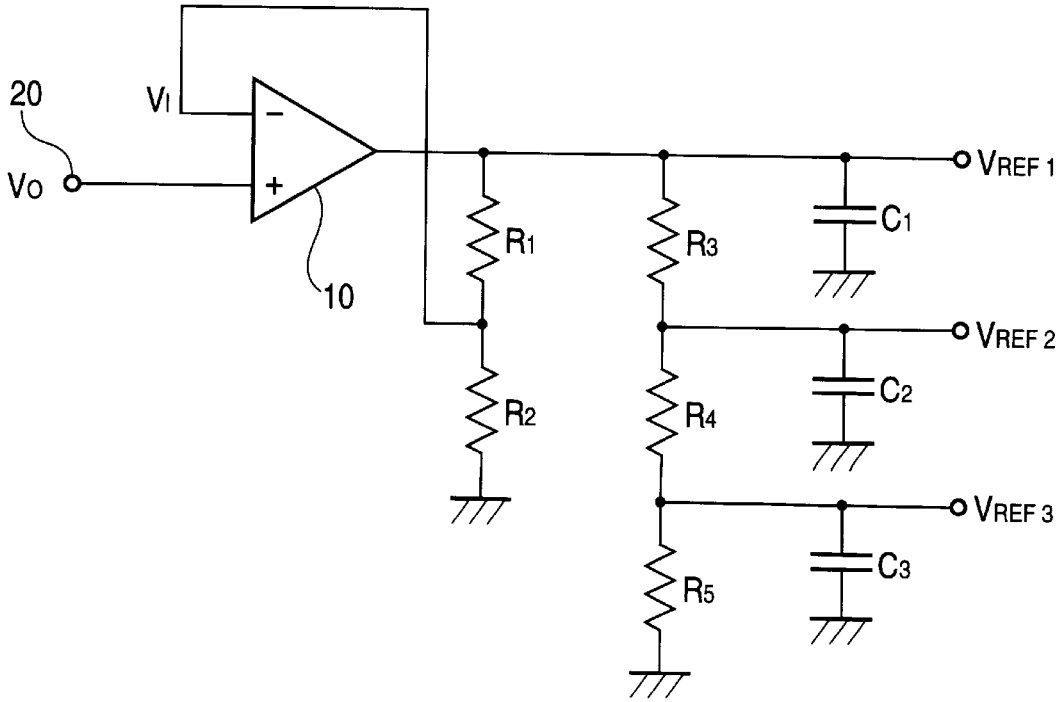
FIG. 5 is a circuit diagram of a first embodiment of the reference voltage generating circuit in accordance with the present invention for generating a plurality of different reference voltages.

Referring to FIG. 5, there is shown a circuit diagram of a first embodiment of the reference voltage generating circuit in accordance with the present invention for generating a plurality of different reference voltages. In FIG. 5. elements similar to those shown in FIGS. 1 to 4 are given the same reference numerals. The shown embodiment is configured to generate three different reference voltages.

Figure 1:
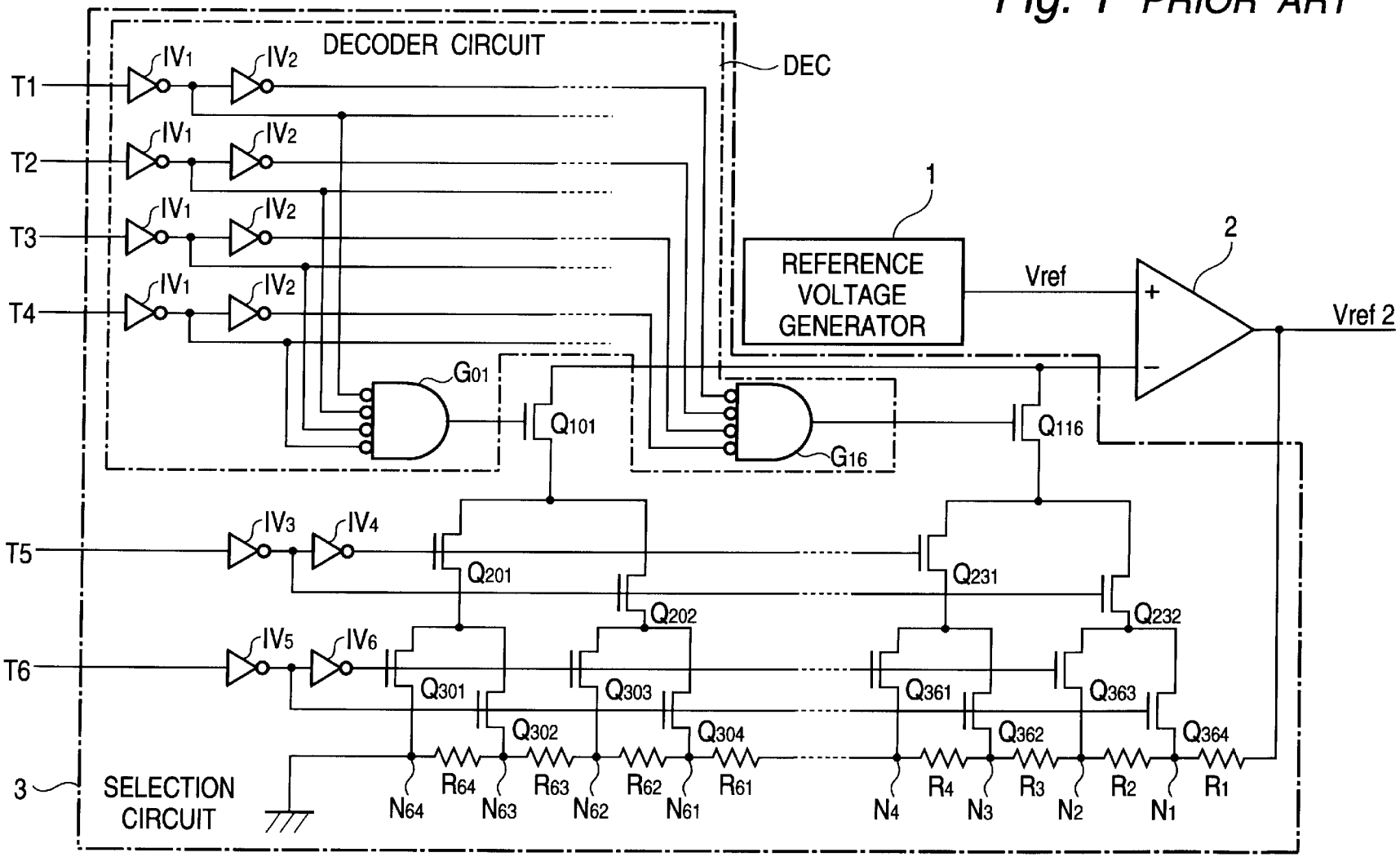
Fig. 1 PRIOR ART
FIG. 1 is a circuit diagram of the prior art reference voltage generating circuit.

The shown embodiment includes a differential amplifier 10 having a non-inverted input 20 connected to receive the constant voltage $V_O$ which corresponds to the reference voltage $V_{ref}$ generated in the reference voltage generator 1 in FIG. 1 and which is at a constant even if a variation occurs in an operating condition including a voltage supply voltage and a temperature. An output of the differential amplifier 10 is connected through series-connected resistors $R_1$ and $R_2$ to the ground, and a connection node between the series-connected resistors $R_1$ and $R_2$ is connected to an inverted input of the differential amplifier 10, so that a divided-voltage $V_1$ is fed back to the inverted input of the differential amplifier 10. Thus, the output of the differential amplifier 10 outputs a first reference voltage $V_{REF1}$. The output of the differential amplifier 10 is also connected through series-connected resistors $R_3$, $R_4$ and $R_5$ to the ground.

With this arrangement, the series-connected resistors $R_1$ and $R_2$ generate a first reference, voltage $V_{REF1}$. From the first reference voltage $V_{REF1}$, the series-connected resistors $R_3$, $R_4$ and $R_5$ generate a second reference voltage $V_{REF2}$ and a third reference voltage $V_{REF3}$ at a connection node between the resistors $R_3$ and $R_4$ and at a connection node between the resistors $R_4$ and $R_5$, respectively. Namely, the series-connected resistors $R_3$, $R_4$ and $R_5$ constitute a voltage divider.

For stabilizing the output reference voltages, capacitors $C_1$, $C_2$ and $C_3$ are connected to the output of the differential amplifier 10, the connection node between the resistors $R_3$ and $R_4$ and the connection node between the resistors $R_4$ and $R_5$, respectively.

Figure 2:
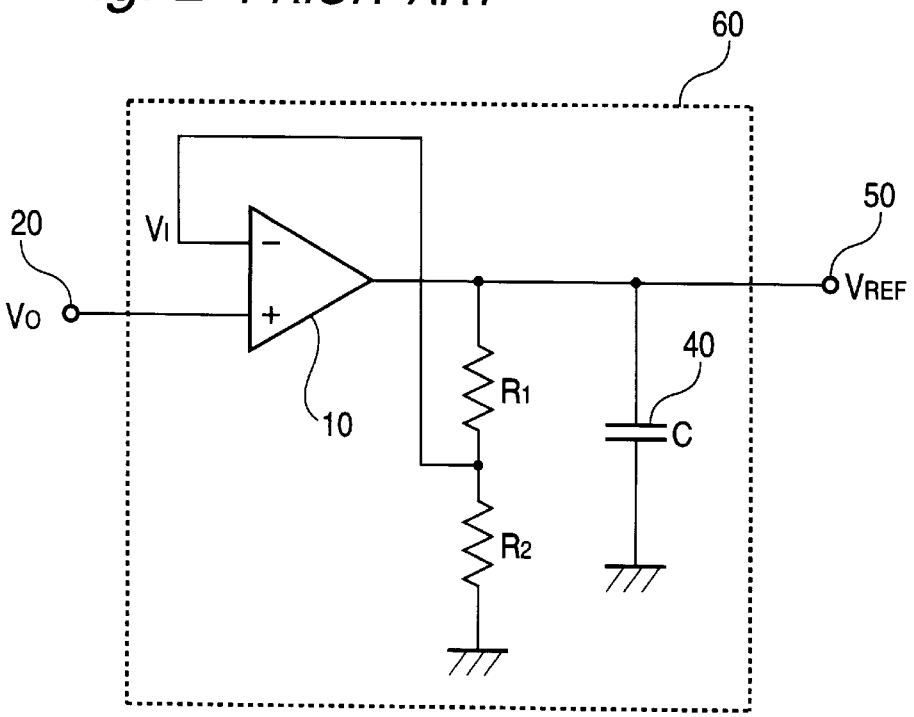
Fig. 2 PRIOR ART
FIG. 2 is a simplified circuit diagram of the prior art reference voltage generating circuit.
Figure 3:
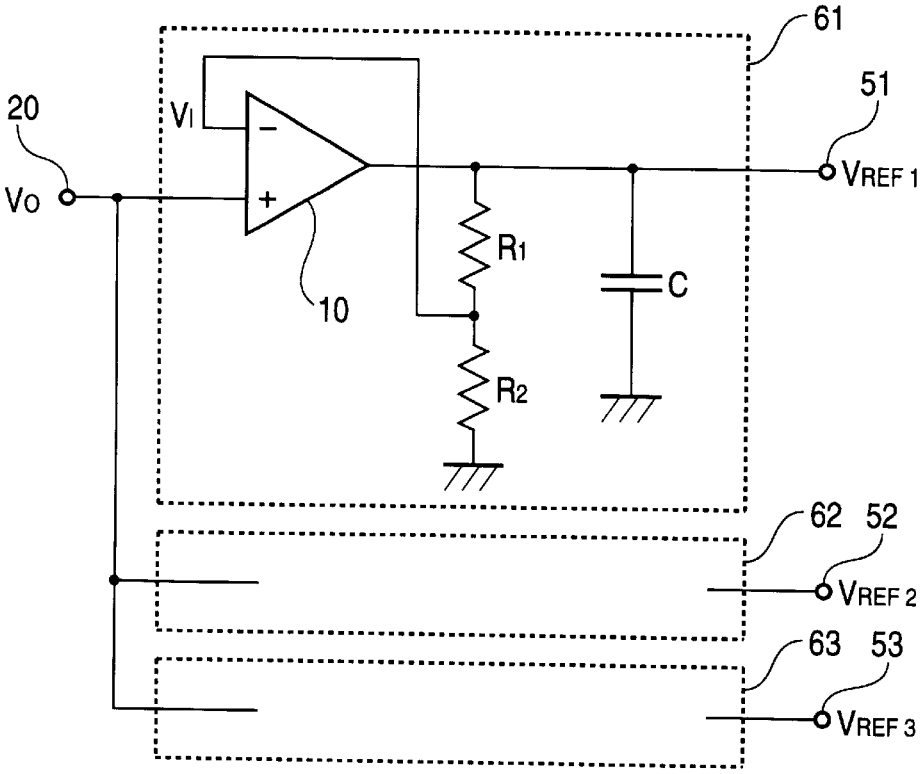
Fig. 3 PRIOR ART
FIG. 3 is a simplified circuit diagram of a plurality of reference voltage generating circuits provided in accordance with the prior art for generating a plurality of different reference voltages.
Figure 4:
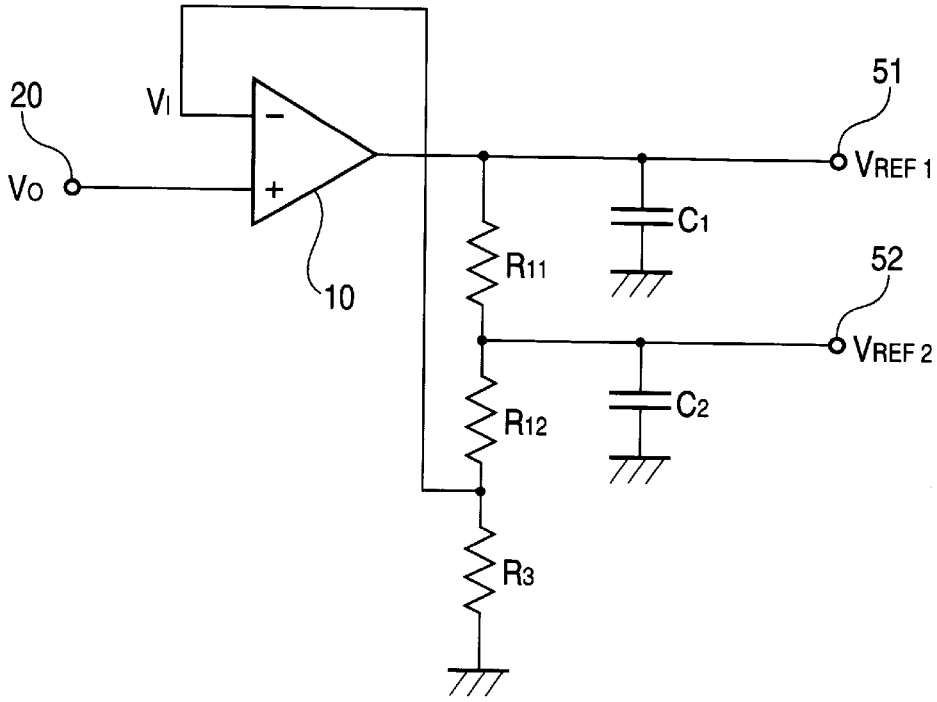
FIG. 4 is a circuit diagram of a supposed single reference voltage generating circuit for generating a plurality of different reference voltages.

As seen from comparison between FIG. 5 and FIGS. 2 and 3, the shown embodiment is characterized in that desired reference voltages are obtained from the first reference voltage $V_{REF1}$ generated by the differential amplifier 10, by action of the voltage divider composed of the series-connected resistors $R_3$, $R_4$ and $R_5$. Therefore, in addition to a first reference voltage generating part constituted of the differential amplifier 10 and the resistors $R_1$ and $R_2$, the voltage divider composed of the series-connected resistors $R_3$, $R_4$ and $R_5$ constitutes a second reference voltage generating part. This second reference voltage generating part is composed of only a passive circuit and is very simple in construction.

$V_{REF1}$, $V_{REF2}$ and $V_{REF3}$ come under the relation expressed as follows:

$$V_{REF1}>V_{REF2}>V_{REF3} \tag{4}$$

Therefore, desired reference voltages are re-arranged to meet this relation, and the resistance values of $R_1$ and $R_2$ are adjusted or set to cause $V_{REF1}$ to fulfill a maximum voltage of the desired reference voltages.

As explained in connection with the prior art, $V_{REF1}$ is expressed as follows:

$$V_{REF1}=V_O\cdot(R_1+R_2)/R_2 \tag{5}$$

In addition, $V_{REF2}$ and $V_{REF3}$ are expressed as follows:

$$V_{REF2}=V_{REF1}\cdot(R_4+R_5)/(R_3+R_4+R_5) \tag{6}$$

$$V_{REF3}=V_{REF1}R_5/(R_3+R_4+R_5) \tag{7}$$

Therefore, the resistance values of $R_3$, $R_4$ and $R_5$ are adjusted or set to cause $V_{REF2}$ and $V_{REF3}$ to fulfill the remaining voltages of the desired reference voltages. In other words, $V_{REF1}$, $V_{REF2}$ and $V_{REF3}$ can be freely set to arbitrary values, by setting the resistance values of $R_1$, $R_2$, $R_3$, $R_4$ and $R_5$.

In the shown embodiment, since only the capacitor $C_1$ connected to $V_{REF1}$ exists in a feedback loop of the differential amplifier, namely, in a path going from the output $V_{REF1}$ of the differential amplifier through the resistor $R_1$ to the inverted input $V_1$ of the differential amplifier, and since the capacitor $C_1$ is positioned upstream of the resistor in the feedback loop, no delay occurs in the feedback control of the differential amplifier. In addition, since the capacitor $C_2$ connected to $V_{REF2}$ and the capacitor $C_3$ connected to $V_{REF3}$ are not positioned in the feedback loop, the feedback control of the differential amplifier is in no way influenced by the capacitor $C_2$ connected to $V_{REF2}$ and the capacitor $C_3$ connected to $V_{REF3}$.

Figure 6:
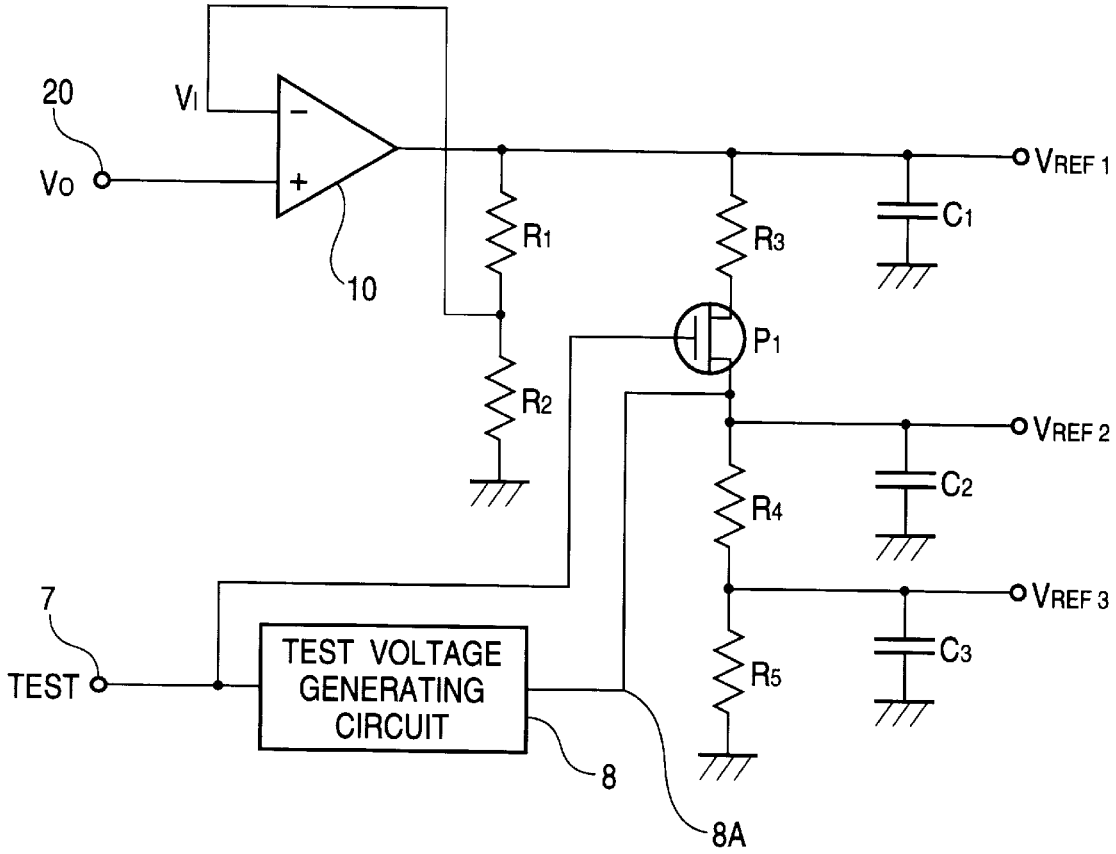
FIG. 6 is a circuit diagram of a second embodiment of the reference voltage generating circuit in accordance with the present invention for generating a plurality of different reference voltages.

Referring to FIG. 6, there is shown a circuit diagram of a second embodiment of the reference voltage generating circuit in accordance with the present invention for generating a plurality of different reference voltages. In FIG. 6, elements corresponding to those shown in FIG. 5 are given the same reference numerals, and explanation thereof will be omitted for simplification of explanation.

The first embodiment is sufficient if it is necessary only to supply a plurality of different constant reference voltages. However, it is not satisfactory in the case that in order to perform a screening to remove an initial or early defect in the semiconductor device, an acceleration test is carried out in which a high voltage is ordinarily applied.

In the semiconductor device, for example, when $V_{REF1}$ is used as a reference voltage of a power supply for a peripheral circuit and $V_{REF2}$ is used as a reference voltage of a power supply for memory cells, the acceleration coefficient is different between the peripheral circuit and the memory cell section, because an insulating oxide film in a memory cell capacitor is ordinarily thinner than a gate oxide film of a transistor in the peripheral circuit. Therefore, the ratio of $V_{REF1}$ to $V_{REF2}$ must be made different from an normal operation to the acceleration test. However, the first embodiment cannot meet this request, since it is apparent that $V_{REF2}$ is determined by the above mentioned equation (6), and therefore, is always in a constant proportion to $V_{REF1}$.

Therefore, the second embodiment includes a P-channel transistor $P_1$ operating as a switch, inserted between the $V_{REF2}$ side terminal of the resistor $R_3$ and the $V_{REF2}$ side terminal of the resistor $R_4$. A gate of this P-channel transistor $P_1$ is connected to receive a test signal TEST which is brought to a high level in the acceleration test. Therefore, in the acceleration test, $V_{REF1}$ is electrically isolated from $V_{REF2}$ by the P-channel transistor $P_1$ which is put in an OFF condition by the high level of the test signal TEST. Furthermore, the second embodiment includes a test power supply voltage generating circuit 8, which has an output voltage terminal 8A connected to the $V_{REF2}$ terminal of the resistor $R_4$, and which is activated by the high level of the signal TEST to supply a test voltage in place of $V_{REF2}$. Thus, the ratio of $V_{REF1}$ to $V_{REF2}$ can take a value different from that in the normal operation.

In this embodiment, $V_{REF3}$ assumes a value expressed by the following equation:

$$V_{REF3}=V_{REF2}\cdot R_5/(R_4+R_5) \quad (8)$$

In this connection, although not shown, it is possible to supply a voltage different from $V_O$, in place of $V_O$, in the acceleration test, so that $V_{REF1}$ is made different from that in the normal operation. In addition, it is also possible to generate $V_{REF3}$ independent of $V_{REF2}$ by adding a circuit similarly to the circuit associated to $V_{REF2}$ in this second embodiment.

When the test signal TEST is at a low level, the P-channel transistor $P_1$ is put in an ON condition, and the test power supply voltage generating circuit 8 is deactivated so that the output voltage terminal 8A is put in a high impedance condition. In this situation, therefore, the second embodiment operates completely similarly to the first embodiment.

As seen from the above, the reference voltage generating circuit in accordance with the present invention is characterized by comprising a first reference voltage generating means including a differential amplifier having a first input connected to receive a constant voltage and a second input connected through a voltage feedback means to an output of the differential amplifier so as to receive a voltage in proportion to a first reference voltage generated by the differential amplifier, and a second reference voltage generating means connected to the output of the differential amplifier and having a current path independent of the voltage feedback means, for generating at least one second reference voltage different from the first reference voltage.

Therefore, a plurality of different reference voltages can efficiently be generated in a single reference voltage generating circuit having a simple construction obtained by adding the second reference voltage generating means to the prior art reference voltage generating circuit. This is very advantageous over the prior art requiring a plurality of reference voltage generating circuits in order to generate a corresponding number of different reference voltages.

The invention has thus been shown and described with reference to the specific embodiments. However, it should be noted that the present invention is in no way limited to the details of the illustrated structures but changes and modifications may be made within the scope of the appended claims.

What is claimed is:

1. A reference voltage generating circuit comprising a differential amplifier having a first input connected to a constant voltage input terminal and an output connected to a first reference voltage output terminal for supplying a first reference voltage, a first resistor having one end connected to said output of said differential amplifier and the other end connected to a second input of said differential amplifier, a second resistor having one end connected to the other end of said first resistor and the other end connected a power supply terminal, a third resistor having one end connected to said first reference voltage output terminal and the other end connected to a second reference voltage output terminal for supplying a second reference voltage different from the first reference voltage, a fourth resistor connected having one end connected to said second reference voltage output terminal and the other end connected to a third reference voltage output terminal, and a fifth resistor having one end connected to said third reference voltage output terminal and the other end connected to said power supply terminal;

said reference voltage generating circuit further including a switch connected between said second reference voltage output terminal and the other end of said third resistor, said switch being put in an OFF condition in response to a test signal, and a test voltage supplying circuit having a voltage output connected to said second reference voltage output terminal and activated in response to said test signal so as to supply a test voltage to said second reference voltage output terminal.

2. A reference voltage generating circuit claimed in claim 1 further including a first stabilizing capacitor connected between said first reference voltage output terminal and said power supply terminal, a second stabilizing capacitor connected between said second reference voltage output terminal and said power supply terminal, and a third stabilizing capacitor connected between said third reference voltage output terminal and said power supply terminal.

* * * * *